US011121483B2

(12) United States Patent
Nakai et al.

(10) Patent No.: US 11,121,483 B2
(45) Date of Patent: Sep. 14, 2021

(54) TERMINAL HOLDER, WIRE HARNESS, AND FIXING STRUCTURE

(71) Applicant: SUMITOMO WIRING SYSTEMS, LTD., Yokkaichi (JP)

(72) Inventors: Hirokazu Nakai, Yokkaichi (JP); Toshimitsu Nakamura, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/763,528

(22) PCT Filed: Nov. 21, 2018

(86) PCT No.: PCT/JP2018/042952
§ 371 (c)(1),
(2) Date: May 12, 2020

(87) PCT Pub. No.: WO2019/103027
PCT Pub. Date: May 31, 2019

(65) Prior Publication Data

US 2020/0366006 A1 Nov. 19, 2020

(30) Foreign Application Priority Data

Nov. 22, 2017 (JP) ..... JP2017-224831

(51) Int. Cl.
*H01R 4/70* (2006.01)
*H01R 4/34* (2006.01)
*H01R 11/12* (2006.01)

(52) U.S. Cl.
CPC ..... *H01R 4/70* (2013.01); *H01R 4/34* (2013.01); *H01R 11/12* (2013.01); *H01R 2201/26* (2013.01)

(58) Field of Classification Search
CPC ... H01R 4/70; H01R 4/34; H01R 9/00; H01R 9/11; H01R 9/16; H01R 9/18; H01R 9/20;
(Continued)

(56) References Cited

U.S. PATENT DOCUMENTS 4,195,194 A * 3/1980 Kuster ..... H01R 4/2462 174/59
4,482,200 A * 11/1984 Willenborg ..... H01R 13/516 439/460
(Continued)

FOREIGN PATENT DOCUMENTS

JP S64-025831 U 2/1989
JP 2016-207484 A 12/2016

*Primary Examiner* — Harshad C Patel
(74) *Attorney, Agent, or Firm* — Oliff PLC

(57) ABSTRACT

A terminal holder for accommodating a plurality of terminal fittings that are attached to respective ends of a plurality of electrical wires, each of the plurality of terminal fittings including a connection that is connected and fixed to an attachment object through a bolt inserted in the connection, and a fixing portion that is fixed to the electrical wire, the terminal holder including: a plurality of through holes in which the connections of the plurality of terminal fittings are to be respectively disposed and that expose the connections; a plurality of accommodations for respectively accommodating the fixing portions of the plurality of terminal fittings; and a partition wall continuously extending between the fixing portions and between the connections of adjacent terminal fittings.

8 Claims, 8 Drawing Sheets

(58) Field of Classification Search
CPC ..... H01R 9/223; H01R 9/226; H01R 9/24; H01R 9/2416; H01R 9/2491; H01R 11/281; H01R 2201/26
See application file for complete search history.

(56) References Cited

U.S. PATENT DOCUMENTS 6,464,538 B2 * 10/2002 Miyazaki ..... H01R 13/6589 439/607.44
6,655,989 B1 * 12/2003 Gale ..... H01R 13/5202 439/559
6,702,612 B2 * 3/2004 Miyazaki ..... H01R 13/521 439/559
7,097,498 B2 * 8/2006 Miyazaki ..... H01R 4/46 439/362
7,246,506 B2 7/2007 Takao et al.
7,291,036 B1 * 11/2007 Daily ..... H02S 40/34 439/487
7,527,523 B2 * 5/2009 Yohn ..... H01R 4/30 439/564
7,572,150 B2 * 8/2009 Matsuoka ..... H01R 13/207 439/626
8,083,540 B1 * 12/2011 Spicer ..... H02S 40/34 439/460
8,466,586 B2 * 6/2013 Tarchinski ..... B60K 6/46 307/328
9,071,023 B2 * 6/2015 Kondo ..... H01R 9/18
9,722,361 B2 * 8/2017 Tanaka ..... H01R 13/6592
9,809,322 B2 * 11/2017 Chrabascz ..... B64D 41/007
9,966,715 B2 * 5/2018 Ishibashi ..... H01R 13/512
10,062,974 B2 * 8/2018 Okamoto ..... H01R 13/6581
10,141,691 B2 * 11/2018 Noro ..... H01R 13/743
10,468,792 B2 * 11/2019 Yamamoto ..... H01R 9/2416
10,897,105 B2 * 1/2021 Iizuka ..... H01R 13/533
2004/0099427 A1 5/2004 Kihira
2009/0137153 A1 * 5/2009 Yoshioka ..... H01R 13/567 439/607.24
2011/0235977 A1 * 9/2011 Yamada ..... G02B 6/383 385/76
2011/0316373 A1 * 12/2011 Kobayashi ..... H02K 11/33 310/71
2013/0092412 A1 * 4/2013 Tanaka ..... H01R 13/65912 174/78
2018/0337471 A1 * 11/2018 Yamamoto ..... H01R 9/2416

* cited by examiner

TERMINAL HOLDER, WIRE HARNESS, AND FIXING STRUCTURE

BACKGROUND

The present disclosure relates to a terminal holder, a wire harness, and a fixing structure.

Conventionally, a vehicle such as an electric vehicle or a hybrid vehicle includes a wire harness for electrically connecting, for example, a battery and an inverter as devices mounted on the vehicle. The wire harness is routed under the floor of the vehicle, for example. The wire harness includes a plurality of electrical wires and a protective tube for covering the plurality of electrical wires (e.g., see JP 2004-171952A). The electrical wires that are drawn out of the protective tube are respectively connected to connection members of the devices through terminal fittings attached to the end portion of the respective electrical wires.

SUMMARY

When connecting each terminal fitting to the connection member on the device side, there is a possibility that a terminal fitting is erroneously attached to a connection member different from the connection member to which the terminal fitting was to be originally attached. For this reason, it is sought to suppress erroneous attachment.

An exemplary aspect of the disclosure provides a terminal holder and a wire harness that can suppress erroneous attachment of terminal fittings.

A terminal holder according to an exemplary aspect is a terminal holder for accommodating a plurality of terminal fittings that are attached to respective ends of a plurality of electrical wires, each of the plurality of terminal fittings including a connection that is connected and fixed to an attachment object through a bolt inserted in the connection, and a fixing portion that is fixed to the electrical wire, the terminal holder including: a plurality of through holes in which the connections of the plurality of terminal fittings are to be respectively disposed and that expose the connections; and a plurality of accommodations for respectively accommodating the fixing portions of the plurality of terminal fittings.

With this configuration, the plurality of terminal fittings respectively attached to the ends of the plurality of electrical wires can be accommodated in the terminal holder, and the plurality of terminal fittings can be collectively attached to the attachment object, and thus erroneous attachment of the terminal fittings can be suppressed.

The terminal holder preferably includes, an engagement for the attachment object on a lower surface.

With this configuration, positioning with respect to the attachment object is facilitated due to the engagement.

In the above terminal holder, preferably, the plurality of accommodations are formed so that the plurality of terminal fittings are arranged in one straight line and the plurality of electrical wires are drawn out in a direction orthogonal to the straight line.

With this configuration, the size of the terminal holder can be reduced, and an increase in the size of a portion to which the terminal fittings are attached can be suppressed.

It is preferable that the terminal holder is formed by a lower holder and an upper holder that are fixed to each other, the lower holder and the upper holder each include accommodating recesses for respectively accommodating the fixing portions of the terminal fittings, each of the terminal fittings includes the fixing portion on one of the two surfaces of the connection, and the upper holder includes a plurality of regulating pieces extending toward the lower holder.

With this configuration, erroneous attachment of the terminal fittings to the terminal holder can be suppressed.

A terminal holder that solves the above issue is formed so as to accommodate a plurality of terminal fittings that each have a connection that is connected and fixed to an attachment object and that are attached to respective ends of a plurality of electrical wires, so that the connections of the plurality of terminal fittings are arranged in a line, and to draw out the plurality of electrical wires in a direction orthogonal to the arrangement direction of the connections.

With this configuration, the plurality of terminal fittings respectively attached to the ends of the plurality of electrical wires can be accommodated in the terminal holder, and the plurality of terminal fittings can be collectively attached to the attachment object. As a result, erroneous attachment of the terminal fittings can be suppressed.

A wire harness that solves the above issue includes: a plurality of electrical wires; a plurality of terminal fittings that are attached to respective ends of the plurality of electrical wires; and a terminal holder for accommodating the plurality of terminal fittings.

With this configuration, the plurality of terminal fittings respectively attached to the ends of the plurality of electrical wires can be accommodated in the terminal holder, and the plurality of terminal fittings can be collectively attached to the attachment object. As a result, erroneous attachment of the terminal fittings can be suppressed.

A fixing structure that solves the above issue is a fixing structure for fixing a plurality of terminal fittings that are attached to respective ends of a plurality electrical wires to a terminal block, and the fixing structure includes a terminal holder to be fixed to the terminal block and for accommodating the plurality of terminal fittings.

With this configuration, the plurality of terminal fittings respectively attached to the ends of the plurality of electrical wires can be accommodated in the terminal holder, and the plurality of terminal fittings can be collectively attached to the terminal block. As a result, erroneous attachment of the terminal fittings can be suppressed.

According to the terminal holder and the wire harness of the present disclosure, erroneous attachment of the terminal fittings can be suppressed.

DETAILED DESCRIPTION OF EMBODIMENTS

Hereinafter, each embodiment will be described.

Note that the accompanying drawings may show components in an enlarged manner for easy understanding. The dimensional proportions of the components may differ from the actual dimensional proportions or from those in another drawing. In the cross-sectional views, some components are not hatched in some cases for easy understanding.

Figure 1:
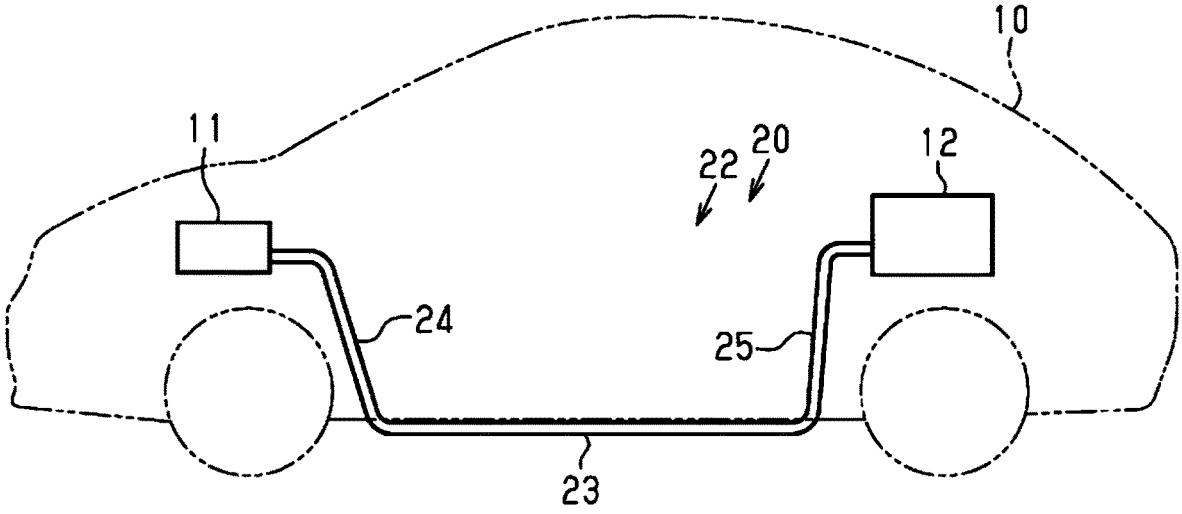
FIG. 1 is a schematic view showing a vehicle in which a wire harness is routed.

A vehicle 10 shown in FIG. 1 is, for example, a hybrid vehicle, an electric vehicle, or the like. The vehicle 10 includes a motor 11 as a device and a power supply source 12 for driving the motor 11. The power supply source 12 includes a high voltage battery and an inverter circuit for driving the motor 11. The motor 11 and the power supply source 12 are electrically connected to each other through a wire harness 20.

The wire harness 20 includes a plurality (for example, three) of electrical wires 21 (see FIG. 2) and a protective tube 22 through which the electrical wires 21 are inserted. For example, the protective tube 22 includes a shield pipe 23, and tubes 24 and 25 at two ends of the shield pipe 23. The shield pipe 23 is formed of a conductive metal material (e.g., an aluminum alloy). The shield pipe 23 is routed so as to pass under the floor of the vehicle 10, and is bent into a predetermined shape. The tubes 24 and 25 are members such as corrugated tubes or grommets, for example.

Figure 3:
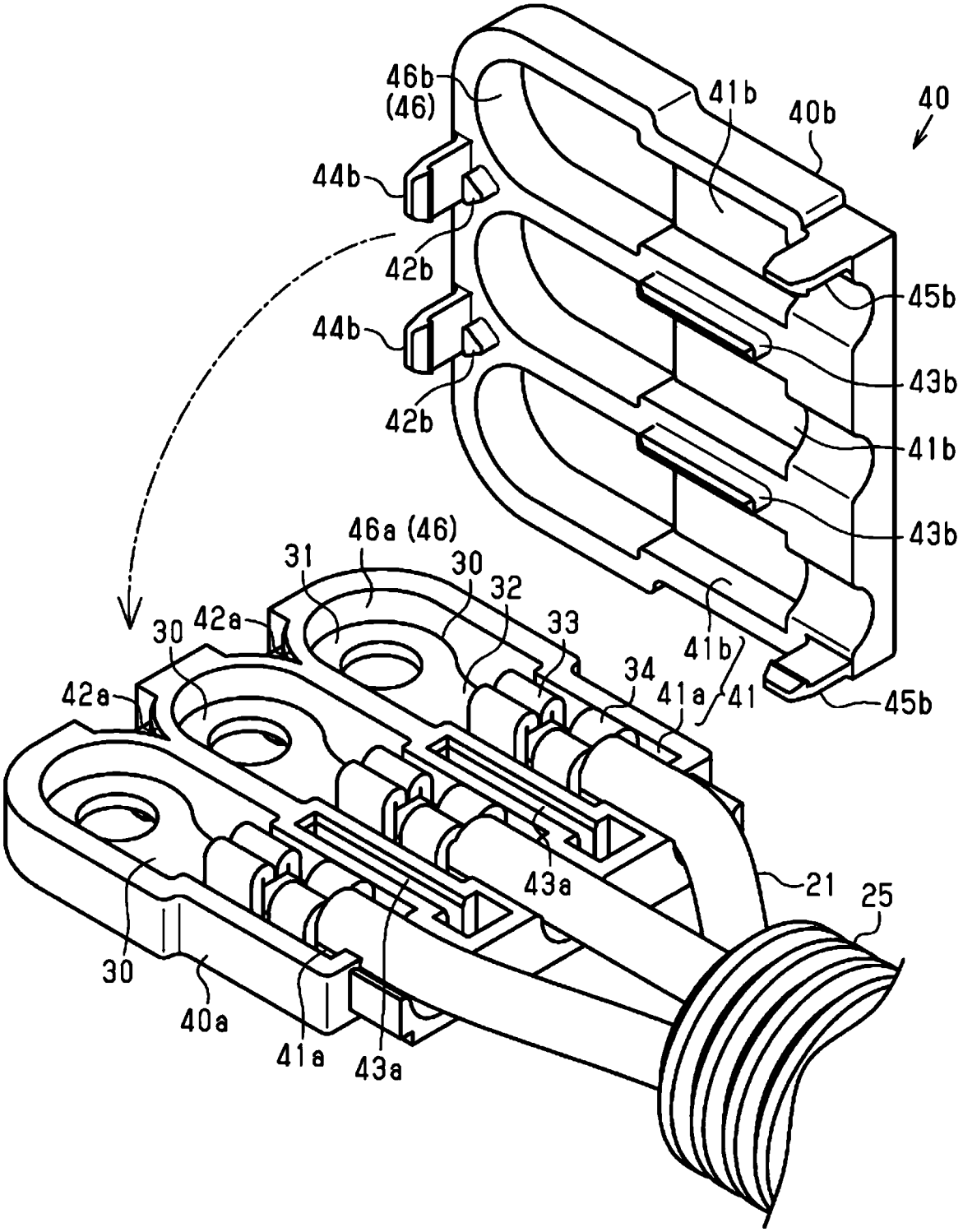
FIG. 3 is an exploded perspective view showing the terminal holder, the electrical wires, and terminal fittings.

As shown in FIG. 3, a terminal fitting 30 is attached to an end portion of each electrical wire 21. The electrical wires 21 have the same shape as each other, and each have a core wire made of copper or aluminum, and an insulating coating surrounding the core wire.

Each terminal fitting 30 includes a connection portion 31 (connection) and an electrical wire fixing portion 32 for fixing the terminal fitting 30 to an electrical wire 21. The electrical wire fixing portion 32 includes a core wire fixing portion 33 and a coating fixing portion 34. The connection portion 31 is formed, for example, in an annular shape. The connection portion 31 is connected to a connection portion (e.g., a terminal block) of a device via a bolt (see FIG. 6(*b*)) that is inserted into an insertion hole 31*x* of the connection portion 31. The core wire fixing portion 33 is connected to the core wire of the electrical wire 21 by crimping. The coating fixing portion 34 is connected to the insulating coating of the electrical wire 21 by crimping.

Figure 2A:
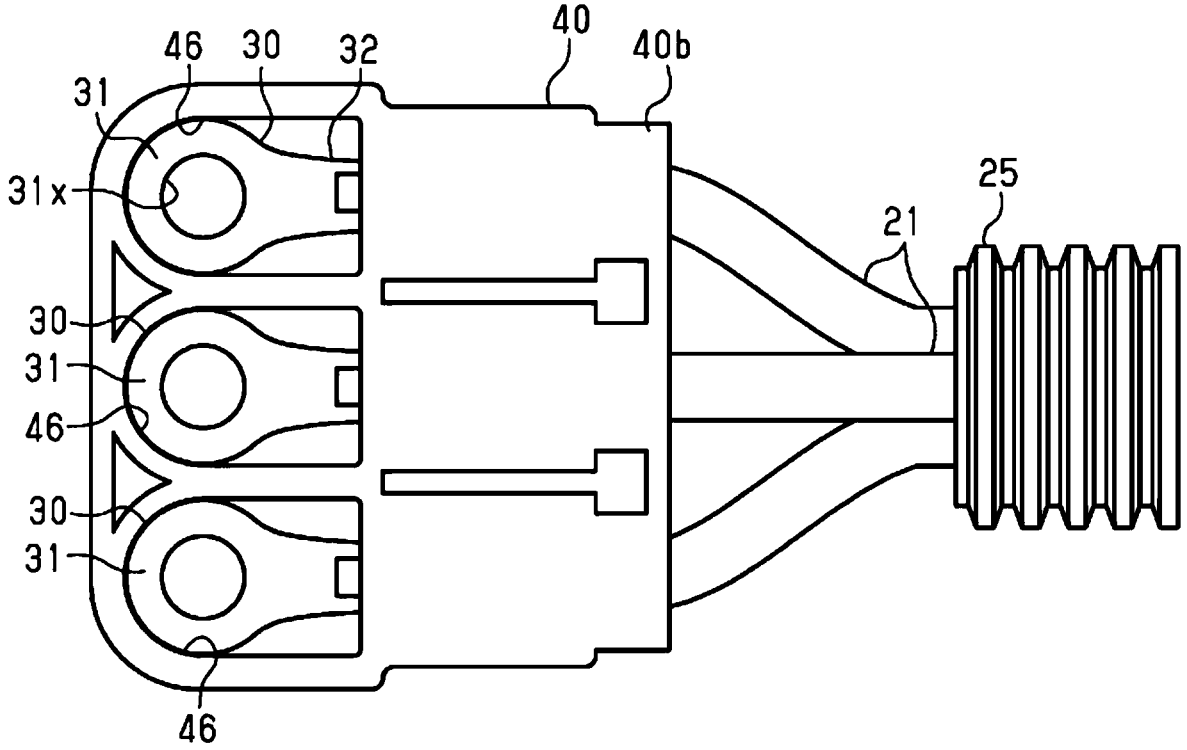
FIG. 2(*a*) is a schematic plan view showing a terminal holder and electrical wires, and FIG. 2(*b*) is a schematic side view showing the terminal holder and the electrical wires.
Figure 2B:
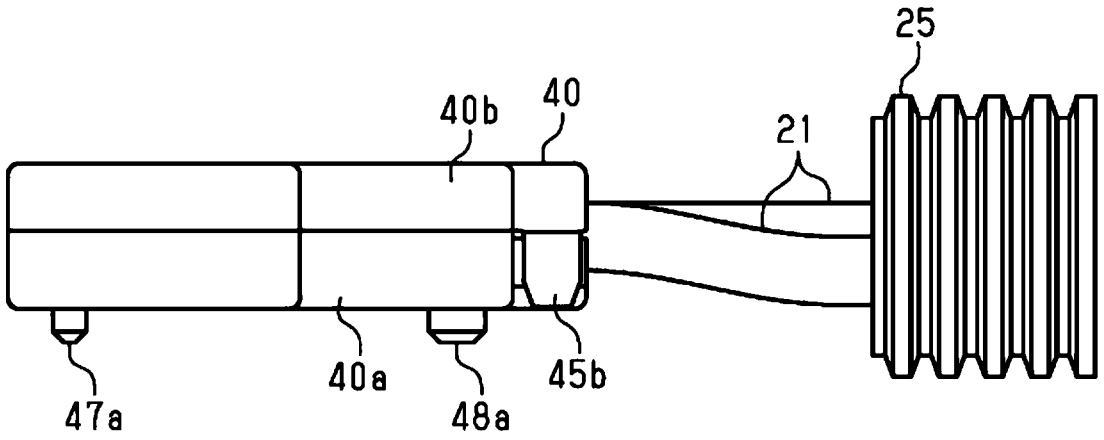

As shown in FIG. 2(*a*), a terminal holder 40 is attached to the end portions (ends) of the electrical wires 21. The terminal holder 40 accommodates the terminal fittings 30 that are respectively attached to the electrical wires 21. The terminal holder 40 is made of a synthetic resin, for example.

As shown in FIGS. 2(*b*), 3, 4, and 5, the terminal holder 40 includes a lower holder 40*a* and an upper holder 40*b*. The lower holder 40*a* includes three lower accommodating portions 41*a*, and the upper holder 40*b* includes three upper accommodating portions 41*b*. The terminal holder 40 accommodates the terminal fittings 30 by the lower accommodating portions 41*a* and the upper accommodating portions 41*b*. Specifically, the lower accommodating portions 41*a* and the upper accommodating portions 41*b* constitute accommodating portions 41 (accommodations) for accommodating the electrical wire fixing portions 32 (the core wire fixing portions 33 and the coating fixing portions 34) of the terminal fittings 30.

Protruding portions 42*b* and 43*b* are formed in the upper holder 40*b*, and recessed portions 42*a* and 43*a* are formed in the lower holder 40*a*. By inserting the protruding portions 42*b* and 43*b* of the upper holder 40*b* into the recessed portions 42*a* and 43*a* of the lower holder 40*a*, the relative displacement between the upper holder 40*b* and the lower holder 40*a* is suppressed. The lower holder 40*a* and the upper holder 40*b* are integrated by engaging lock portions 44*b* and 45*b* of the upper holder 40*b* with the lower holder 40*a*.

As shown in FIG. 2(*a*), the upper holder 40*b* is formed with upper through holes 46*b* that expose the connection portions 31 of the terminal fittings 30 on the upper surface side of the upper holder 40*b*. The upper through holes 46*b* are formed so as to pass though the upper holder 40*b* in the thickness direction, and to expose respective terminal fittings 30 separately.

As shown in FIG. 3, the lower holder 40*a* is formed with lower through holes 46*a* that expose the connection portions 31 of the terminal fittings 30 on the lower surface side of the lower holder 40*a*. The lower through holes 46*a* are formed so as to pass through the lower holder 40*a* in the thickness direction, and to expose respective terminal fittings 30 separately.

Note that in the present embodiment, the upper through holes 46*b* and the lower through holes 46*a* are formed such that their inner walls are continuous. The upper through holes 46*b* and the lower through holes 46*a* form through holes that pass though the terminal holder 40 in the thickness direction. The above-mentioned terminal accommodating portions (the lower accommodating portions 41*a* and the upper accommodating portions 41*b*) communicate with the upper through holes 46*b* and the lower through holes 46*a*. The upper through holes 46*b* and the lower through holes 46*a* constitute through holes 46 that pass through the terminal holder 40 in the vertical direction.

Figure 4:
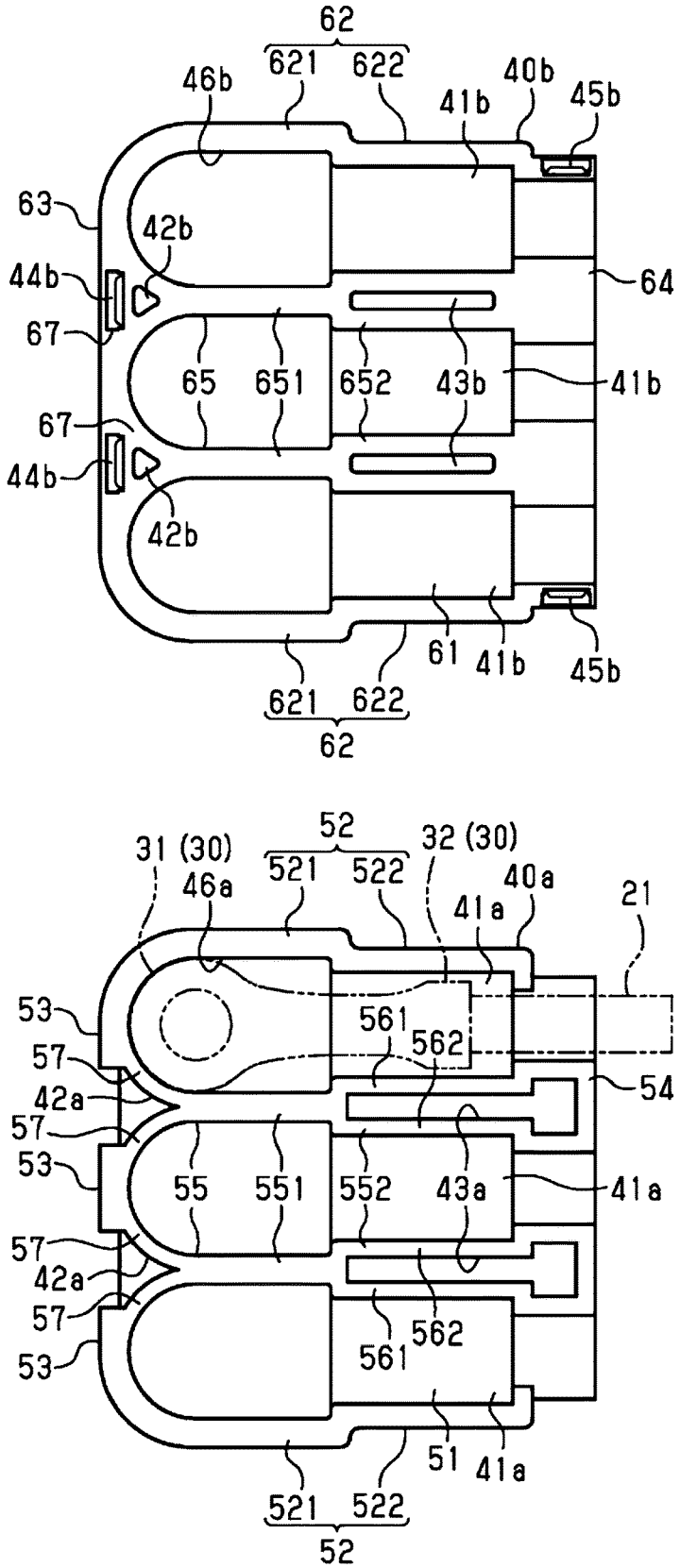
FIG. 4 is an explanatory view of an upper holder and a lower holder.

As shown in FIG. 4, the lower holder 40*a* includes a lower plate portion 51, a pair of side wall portions 52, a front end side wall portion 53, and an electrical wire side wall portion 54. The lower plate portion 51 constitutes a part of side walls of the above-mentioned lower through holes 46*a*. That is, the lower plate portion 51 is formed only in portions corresponding to the above-mentioned lower accommodating portions 41*a*. The pair of side wall portions 52, the front end side wall portion 53, and the electrical wire side wall portion 54 are formed in an approximately rectangular frame shape. In the present embodiment, the side wall portion 52 and the front end side wall portion 53 are formed so as to be continuous with a predetermined radius (a radius corresponding to the outer diameter of a connection portion 31 of a terminal fitting 30).

A plurality (two in the present embodiment) of partition walls 55 are formed between the pair of side wall portions 52. The two partition walls 55 partition the space between the pair of side wall portions 52 to form the above-mentioned lower accommodating portions 41*a* and the lower through holes 46*a*. The pair of side wall portions 52 are constituted by first side wall portions 521 forming the lower through holes 46*a* and second side wall portions 522 forming the lower accommodating portions 41*a*. The second side wall portions 522 are located inside the lower holder 40*a* with respect to the first side wall portions 521.

The partition walls 55 are constituted by first partition walls 551 forming the lower through holes 46*a* and second partition walls 552 forming the lower accommodating portions 41*a*.

The distance between the first side wall portions 521 and the first partition walls 551 and the distance between the two first partition walls 551 are set to accommodate the connection portions 31 of the terminal fittings 30 while allowing some play.

Each second partition wall 552 is composed of a pair of wall members 561 and 562 extending parallel to each other. One end (left end in FIG. 4) of the pair of wall members 561 and 562 is connected to the first partition wall 551, and the other end (right end in FIG. 4) of the pair of wall members 561 and 562 is connected to the electrical wire side wall portion 54.

In one second partition wall 552, the distance between the wall member 561 and the wall member 562 is set in correspondence with the above-mentioned protruding portion 43*b*. For example, the distance between the wall members 561 and 562 is set such that the protruding portion 43*b* formed as a ridge can fit.

In FIG. 4, the distance between the second side wall portion 522 of the side wall portion 52 on the upper side and the wall member 561 of the second partition wall 552 on the upper side is set to accommodate the electrical wire fixing portion 32 of the terminal fitting 30 while allowing some play. Similarly, the distance between the wall member 562 of the second partition wall 552 on the upper side and the wall member 561 of the second partition wall 552 on the lower side and the distance between the wall member 562 of the second partition wall 552 on the lower side and the second side wall portion 522 of the side wall portion 52 on the lower side are set to accommodate the electrical wire fixing portions 32 of the terminal fittings 30 while allowing some play.

The first partition walls 551 and the front end side wall portion 53 are connected through arc-shaped connecting wall portions 57 with inner surfaces having the predetermined radius (the radius according to the outer diameter of the connection portion 31 of the terminal fitting 30). The connecting wall portions 57 each have an outer surface formed in an arc shape corresponding to the inner surface. The outer surfaces of the connecting wall portions 57 form the above-mentioned recessed portions 42*a*.

The upper holder 40*b* includes an upper plate portion 61, a pair of side wall portions 62, a front end side wall portion 63, and an electrical wire side wall portion 64. Similarly to the lower plate portion 51, the upper plate portion 61 constitutes a part of side walls of the above-mentioned upper through holes 46*b*. That is, the upper plate portion 61 is formed only in portions corresponding to the above-mentioned upper accommodating portions 41*b*. The pair of side wall portions 62, the front end side wall portion 63, and the electrical wire side wall portion 64 are formed in an approximately rectangular frame shape. In the present embodiment, the side wall portion 62 and the front end side wall portion 63 are formed so as to be continuous with the predetermined radius (the radius corresponding to the outer diameter of the connection portion 31 of the terminal fitting 30).

A plurality (two in the present embodiment) of partition walls 65 are formed between the pair of side wall portions 62. The two partition walls 65 partition the space between the pair of side wall portions 62 to form the above-mentioned upper accommodating portions 41*b* and the upper through holes 46*b*.

The side wall portions 62 are constituted by first side wall portions 621 forming the upper through holes 46*b* and second side wall portions 622 forming the upper accommodating portions 41*b*. The second side wall portions 622 are located inside the upper holder 40*b* with respect to the first side wall portions 621.

The partition walls 65 are constituted by first partition walls 651 forming the upper through holes 46*b* and second partition walls 652 forming the upper accommodating portions 41*b*.

The thickness of the second partition walls 652 is formed to be thicker than the thickness of the first partition walls 651. The distance between the first side wall portions 621 and the first partition walls 651 and the distance between the two first partition walls 651 are set to accommodate the connection portions 31 of the terminal fittings 30 shown in FIG. 3 while allowing some play. Also, the distances between the second side wall portions 622 and the second partition walls 652 and the distance between the two second partition walls 652 are set to accommodate the electrical wire fixing portions 32 of the terminal fittings 30 shown in FIG. 3 while allowing some play.

The first partition walls 651 and the front end side wall portion 63 are formed such that their inner surfaces are continuous with the predetermined radius (the radius corresponding to the outer diameter of the connection portion 31 of the terminal fitting 30). On the lower surfaces of the connection portions 67 between the first partition walls 651 and the front end side wall portion 63, the above-mentioned protruding portions 42*b* and the lock portions 44*b* are formed so as to protrude.

On the lower surfaces of the second partition walls 652, the above-mentioned protruding portions 43*b* are formed. The protruding portions 43*b* are formed as ridges extending along the second partition walls 652.

Figure 5:
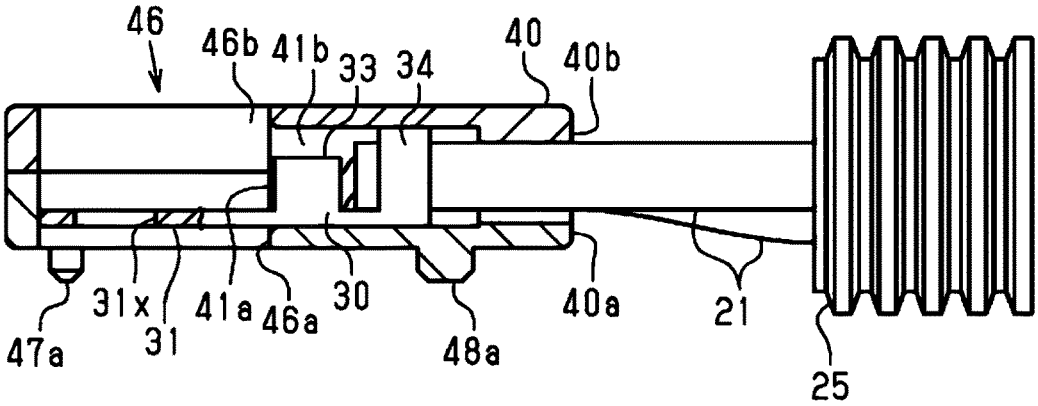
FIG. 5 is a partial cross-sectional view schematically showing the terminal holder, the electrical wires, and the terminal fittings.

As shown in FIG. 5, on the lower surface of the lower holder 40*a*, protruding portions 47*a* and 48*a* are formed.

In the present embodiment, the terminal holder 40 is formed such that the connection portions 31 of the terminal fittings 30 to be accommodated are arranged in one straight line, and the electrical wires 21 are drawn out in a direction orthogonal to the arrangement direction.

Next, a fixing structure using the above-mentioned terminal holder 40 will be described.

Figure 6A:
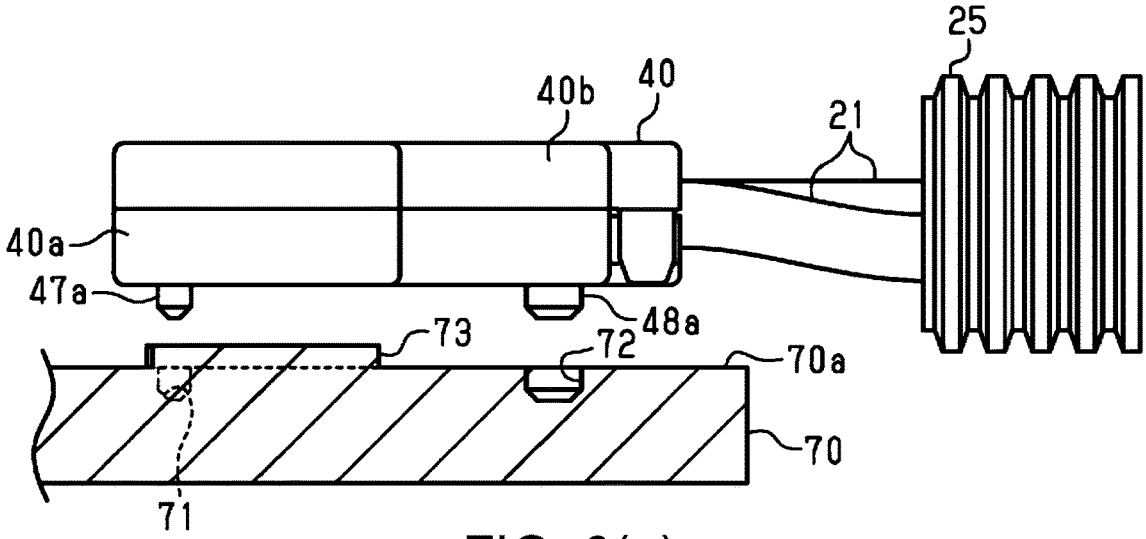
FIGS. 6(*a*) and 6(*b*) are explanatory views showing a terminal holder and a terminal block of a fixing structure.
Figure 6B:
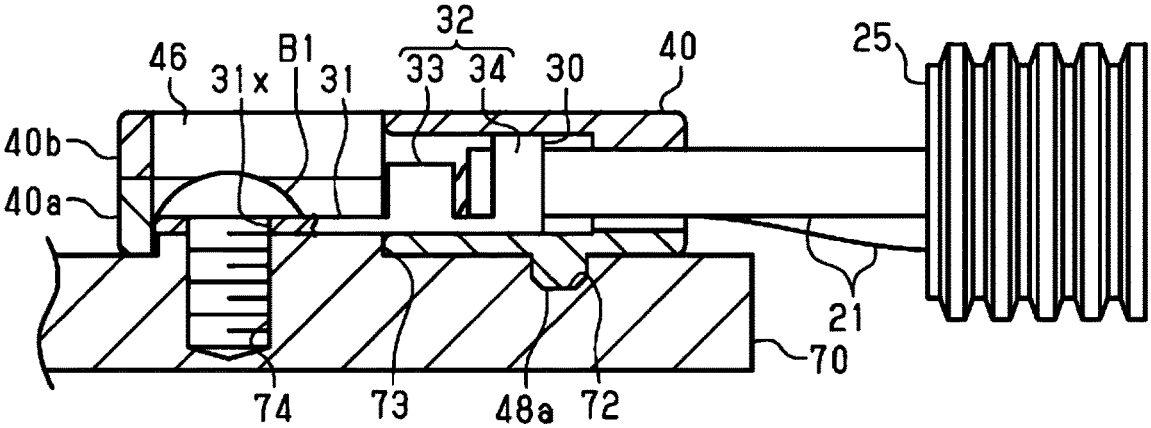

As shown in FIG. 6(*b*), the terminal holder 40 is fixed to a terminal block 70 through fixing screws B1. As shown in FIGS. 6(*a*) and 6(*b*), in an upper surface 70*a* of the terminal block 70, recessed portions 71 and 72 are formed. The recessed portions 71 and 72 are formed in correspondence with the protruding portions 47*a* and 48*a* of the terminal holder 40. Also, connection portions 73 are formed to project from the upper surface 70*a* of the terminal block 70. The connection portions 73 are formed in correspondence with the through holes 46 of the terminal holder 40 (see FIGS. 4 and 5). Although one connection portion 31 is shown in FIG. 6(*a*), three connection portions 31 in correspondence with the through holes 46 of the terminal holder 40 are formed on the terminal block 70. Also, screw holes 74 are formed in the terminal block 70. The screw holes 74 are formed in correspondence with the insertion holes 31*x* of the terminal fittings 30 accommodated in the terminal holder 40.

As shown in FIGS. 6(*a*) and 6(*b*), the protruding portions 47*a* and 48*a* of the terminal holder 40 are inserted into the recessed portions 71 and 72 of the terminal block, respectively. In this manner, the terminal holder 40 is positioned with respect to the terminal block 70. The fixing screws B1 are respectively inserted into the insertion holes 31*x* of the terminal fittings 30, and are screwed into the screw holes 74 of the terminal block 70. The terminal holder 40 and the terminal fittings 30 are fixed to the terminal block 70 through the fixing screws B1. Then, the terminal fittings 30 are respectively fixed to the connection portions 73 of the terminal block 70, and are electrically connected to the terminal block 70.

Operation

The above-mentioned terminal holder 40 and the terminal fittings 30 accommodated in the terminal holder 40 are fixed to, for example, the terminal block as an attachment object.

By inserting the protruding portions 47*a* and 48*a* of the terminal holder 40 into the recessed portions 71 and 72 of the terminal block 70, the terminal holder 40 is positioned with respect to the terminal block 70. Then, the engagement between the protruding portions 47*a* and 48*a* and the recessed portions 71 and 72 restricts the movement of the terminal holder 40 along the upper surface 70*a* of the terminal block 70. In this state, as shown in FIG. 6(*b*), the insertion holes 31*x* of the terminal fittings 30 are aligned with the fixing screw holes 74 of the terminal block 70. Also, the connection portions 31 of the terminal fittings 30 abut on the upper surface of the connection portions 73 of the terminal block 70. In this state, by screwing the fixing screws B1 into the screw holes 74 of the terminal block 70 via the insertion holes 31*x* of the connection portions 31 of the terminal fittings 30, the terminal fittings 30 are fixed to the terminal block 70, and the core wires of the electrical wires 21 are electrically connected to the terminal block 70 via the terminal fittings 30.

When each of the terminal fittings 30 is fixed to the terminal block, erroneous attachment may occur. Also, the lengths of the electrical wires 21 drawn out of the tube 25, that is, the positions of the terminal fittings 30, may be different due to the bending and elongation of the electrical wires 21. Because of this, adjustment of the positions of the terminal fittings 30 may take time and effort, and it may take time to attach.

On the other hand, in the present embodiment, by using the terminal holder 40 that accommodates the three terminal fittings 30, the three terminal fittings 30 can be collectively arranged on the terminal block 70. Accordingly, the terminal fittings 30 can be arranged at desired positions in a short time.

Also, the arrangement of the terminal fittings 30 is determined by accommodating the three terminal fittings 30 in the terminal holder 40 in advance. For this reason, when attaching the terminal fittings 30 to the terminal block 70, erroneous attachment for fixing a terminal fitting 30 to an incorrect position does not occur.

Also, a method to prevent erroneous attachment by making the lengths of the plurality of electrical wires drawn out of the tube different from each other is conceivable. However, in this method, because terminal fittings attached to the front end of the electrical wires having different lengths are respectively attached, the terminal block becomes large. In addition, the lengths from the terminal fittings to the tube become longer, and the portions required for the connection also become larger.

In contrast, the terminal holder 40 of the present embodiment is formed so that the terminal fittings 30 are disposed in a straight line, and the electrical wires 21 are drawn out in a direction orthogonal to the straight line in which the terminal fittings 30 are disposed. Therefore, the portions for connecting the terminal fittings 30 are small. In addition, the lengths from the terminal fittings 30 to the tube are shortened, and the portions required for the connection can be reduced in size.

As described above, according to the present embodiment, the following effect can be obtained.

(1) The arrangement of the terminal fittings 30 is determined by accommodating the three terminal fittings 30 in the terminal holder 40 in advance. For this reason, when attaching the terminal fittings 30 to the terminal block 70, erroneous attachment for fixing a terminal fitting to an incorrect position can be suppressed.

(2) By using the terminal holder 40 that accommodates three terminal fittings 30, the three terminal fittings 30 can be collectively disposed on the terminal block 70. Accordingly, the terminal fittings 30 can be disposed at desired positions in a short time.

(3) The terminal holder 40 is formed so that the terminal fittings 30 are disposed in a straight line, and the electrical wires 21 are drawn out in a direction orthogonal to the straight line in which the terminal fittings 30 are disposed. Therefore, the portions for connecting the terminal fittings 30 are small. In addition, the lengths from the terminal fittings 30 to the tube are shortened, and the portions required for the connection can be reduced in size.

(4) Because the terminal fittings 30 are accommodated in the terminal holder 40, that is, the terminal fittings 30 are covered by the terminal holder 40, it is possible to prevent the terminal fittings 30 from damaging other components and the like.

Modifications

The above embodiment may be implemented by the following modes.

Note that the same members as those in the above embodiment are denoted by the same reference numerals, and a part or all of the description may be omitted.

Figure 7:
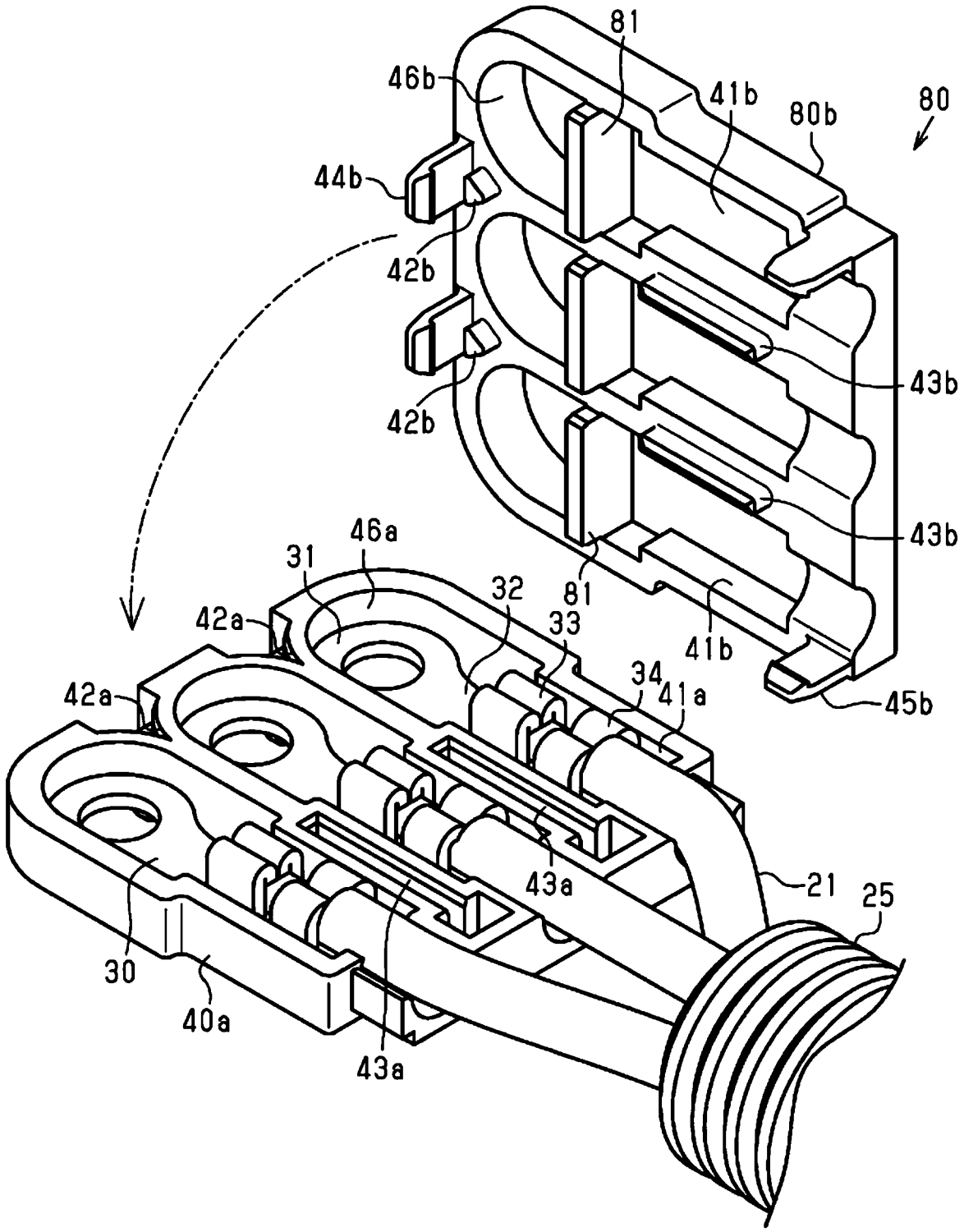
FIG. 7 is an exploded perspective view showing a terminal holder, electrical wires, and terminal fittings in a modification.
Figure 8:
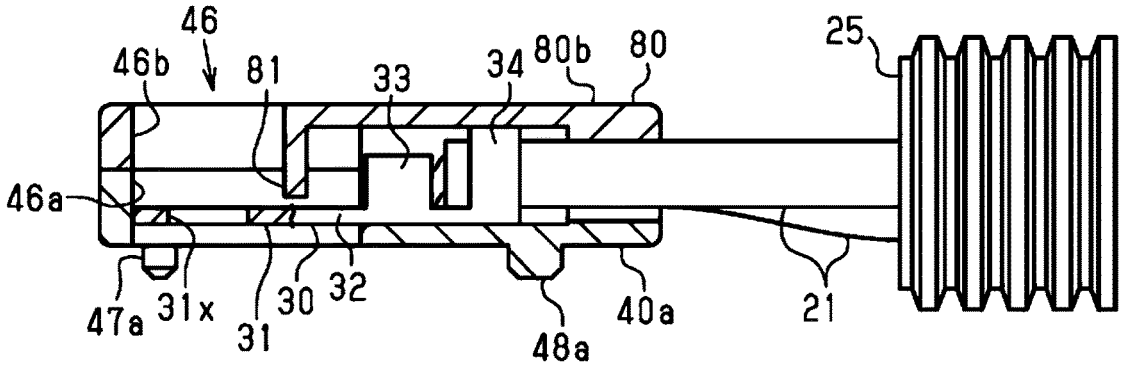
FIG. 8 is a partial cross-sectional view schematically showing the terminal holder, the electrical wires, and the terminal fittings in the modification.

As shown in FIGS. 7 and 8, a terminal holder 80 has an upper holder 80*b* and the lower holder 40*a*. The upper holder 80*b* includes regulating pieces 81 extending toward the lower holder 40*a*. As shown in FIG. 8, the regulating pieces 81 are formed such that their front ends are disposed in the lower holder 40*a*.

The terminal fittings 30 are formed through punching and bending a plate material. Each terminal fitting 30 has the core wire fixing portion 33 and the coating fixing portion 34 on one surface side of the connection portion 31. Each regulating piece 81 is formed so as to extend to a position where the core wire fixing portion 33 and the coating fixing portion 34 are disposed.

Such a terminal holder 40 reduces erroneous attachment of the terminal fittings 30 to the terminal holder 40. For example, in FIG. 8, when the terminal fittings 30 are arranged upside down with respect to the lower holder 40*a*, the regulating pieces 81 of the upper holder 80*b* engage with the terminal fittings 30, and the upper holder 80*b* cannot be fixed to the lower holder 40*a*. That is, by properly disposing the terminal fittings 30 with respect to the lower holder 40*a*, the upper holder 80*b* can be fixed to the lower holder 40*a*. For this reason, erroneous attachment of the terminal fittings 30 to the terminal holder 40 can be reduced.

Figure 9:
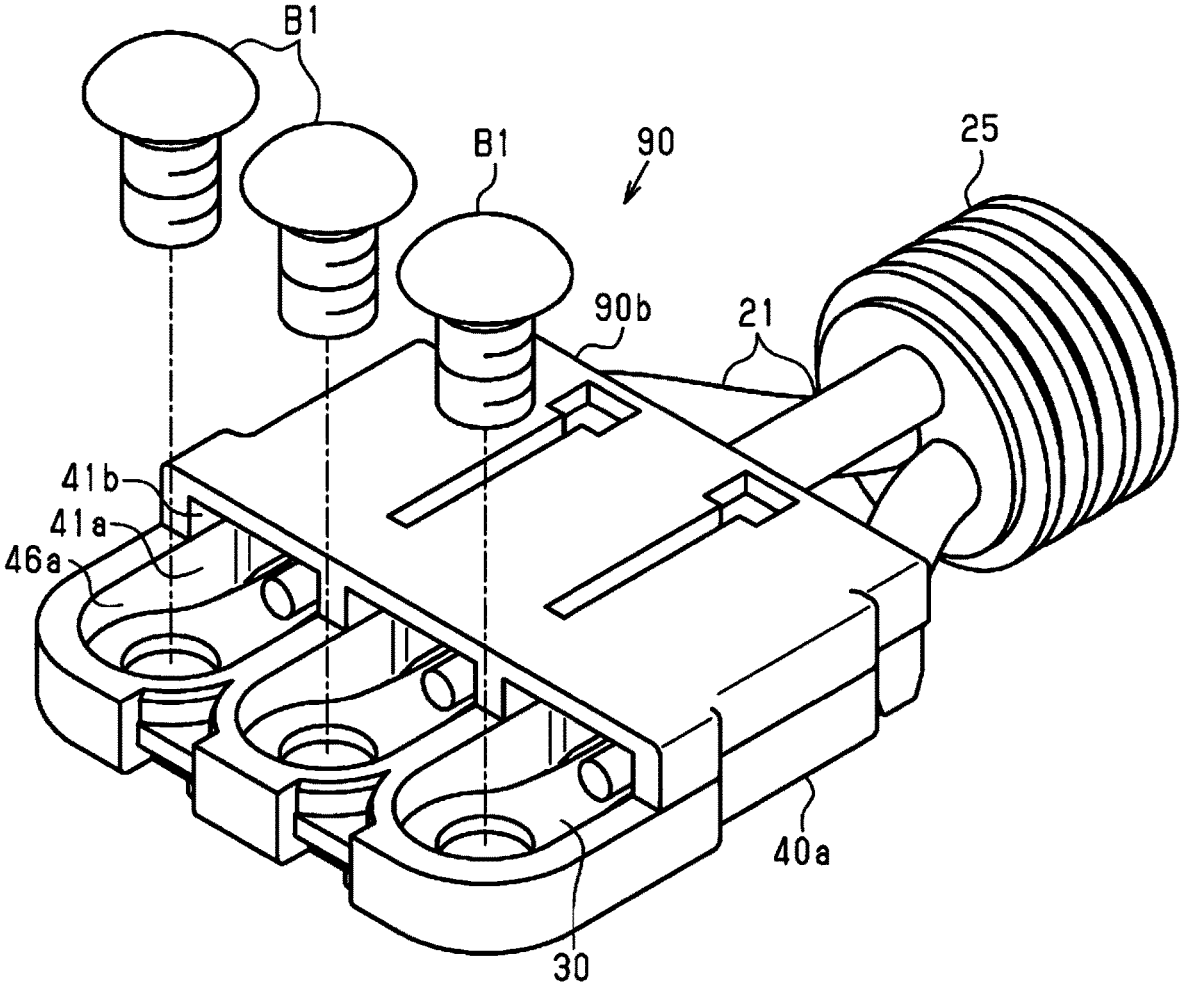
FIG. 9 is a perspective view showing the terminal holder, the electrical wires, and the terminal fittings in the modification.

As shown in FIG. 9, a terminal holder 90 includes an upper holder 90*b* and the lower holder 40*a*. The upper holder 90*b* includes, with respect to the above-mentioned upper holder 40*b*, upper accommodating portions 41*b* that respectively accommodate the core wire fixing portions 33 and the coating fixing portions 34 (see FIGS. 3 and 7) of the terminal fittings 30 accommodated in the terminal holder 90, and the portions forming the upper through holes 46*b* of the above embodiment are omitted.

In the terminal holder 40 of the above embodiment, the connection portions 31 of the terminal fittings 30 to be accommodated are arranged in one straight line, and the electrical wires 21 are drawn out in a direction orthogonal to the arrangement direction. However, the arrangement of the plurality of connection portions 31 and the drawing-out direction of the electrical wires 21 are not limited to this.

Figure 10A:
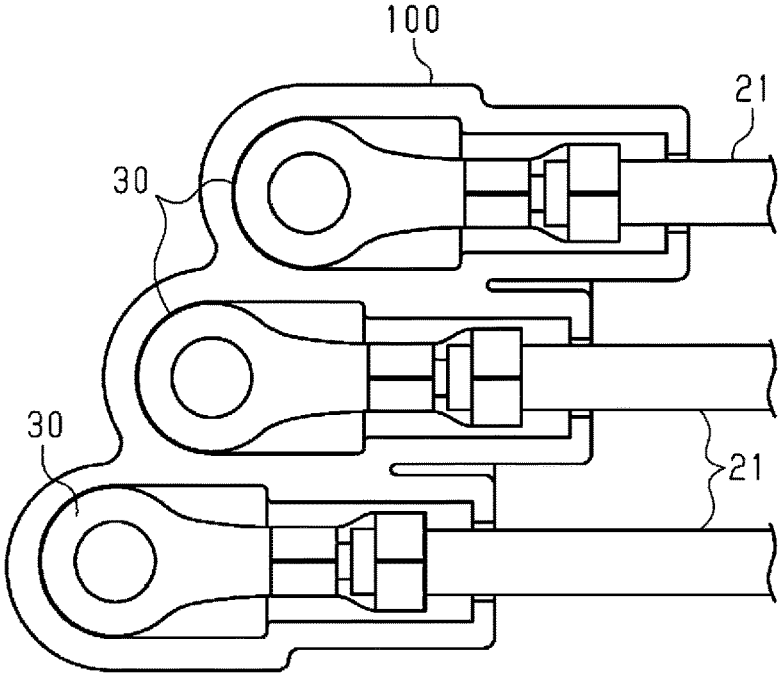
FIGS. 10(*a*) and 10(*b*) are schematic explanatory views showing a terminal holder (a lower holder) in the modification.
Figure 10B:
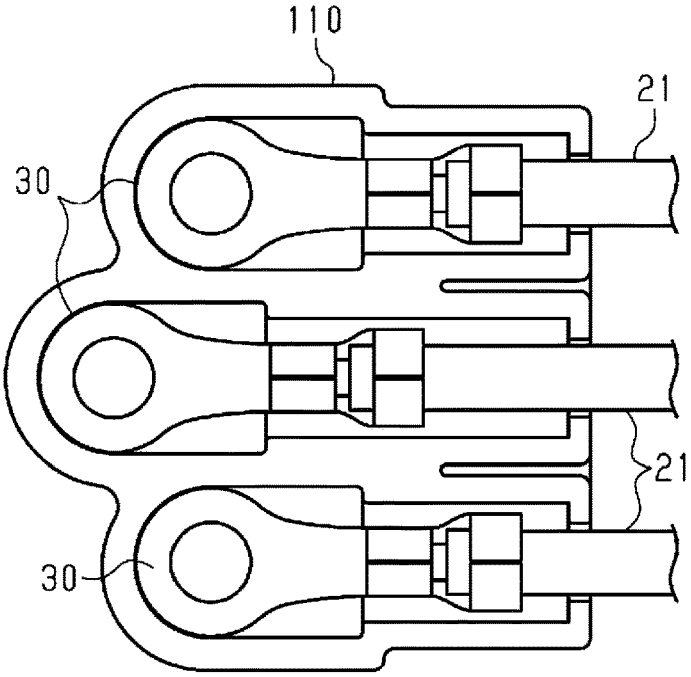

For example, as shown in FIG. 10(*a*), a terminal holder 100 arranges the terminal fittings 30 in one straight line, and accommodates the terminal fittings 30 at positions shifted with respect to the drawing-out direction of the electrical wires 21 (rightward in FIG. 10(*a*)). That is, the terminal holder 100 is formed such that the direction in which the terminal fittings 30 are arranged (the direction in which the straight line in which the terminal fittings 30 are arranged extends) and the direction in which the electrical wires 21 are drawn out form a predetermined angle (an acute angle).

Also, as shown in FIG. 10(*b*), a terminal holder 110 accommodates three terminal fittings 30. The terminal holder 110 accommodates one terminal fitting 30 (e.g., the central terminal fitting 30 in FIG. 10(*b*)) at a position shifted from the other two terminal fittings 30 (e.g., the upper and lower terminal fittings 30 in FIG. 10(*b*)) in the drawing-out direction of the electrical wires 21. In FIG. 10(*b*), one terminal fitting 30 is accommodated so as to be shifted in a direction opposite to the drawing-out direction (right direction) of the electrical wires 21. Note that one terminal fitting 30 may also be accommodated in a position shifted in the drawing-out direction of the electrical wires 21.

With respect to the above embodiments, a terminal holder that accommodates two or four or more terminal fittings may also be used.

With respect to the above embodiments, a recessed portion may also be formed in the terminal holder for alignment with the terminal block, and a protruding portion may also be formed on the terminal block.

With respect to the above embodiments, the upper holder 40*b*, 80*b*, or 90*b* and the lower holder 40*a* may also be connected by a hinge.

It will be apparent to those skilled in the art that the present disclosure may also be embodied in other specific forms without departing from the spirit thereof. For example, some of the components described in the embodiments (or one or more aspects thereof) may also be omitted or some components may also be combined.

The invention claimed is:

1. A terminal holder for accommodating a plurality of terminal fittings that are attached to respective ends of a plurality of electrical wires, each of the plurality of terminal fittings including a connection that is connected and fixed to an attachment object through a bolt inserted in the connection, and a fixing portion that is fixed to the electrical wire, the terminal holder comprising:

a plurality of through holes in which the connections of the plurality of terminal fittings are to be respectively disposed and that expose the connections;

a plurality of accommodations for respectively accommodating the fixing portions of the plurality of terminal fittings; and a partition wall continuously extending between the fixing portions and between the connections of adjacent terminal fittings, wherein the partition wall between the fixing portions of the adjacent terminal fittings is composed of two walls that are separated by a predetermined distance, such that a protruding portion of the terminal holder fits between the two walls.

2. The terminal holder according to claim 1, comprising:

an engagement for the attachment object on a lower surface.

3. The terminal holder according to claim 1, wherein the plurality of accommodations are formed so that the plurality of terminal fittings are arranged in one straight line, and the plurality of electrical wires are drawn out in a direction orthogonal to the straight line.

4. The terminal holder according to claim 1, wherein:

the terminal holder is formed by a lower holder and an upper holder that are fixed to each other, the lower holder and the upper holder each include accommodating recesses for respectively accommodating the fixing portions of the terminal fittings, each of the terminal fittings includes the fixing portion on a wire-side end of the connection, and the upper holder includes a plurality of regulating pieces extending toward the lower holder.

5. A wire harness, comprising:

the plurality of electrical wires;

the plurality of terminal fittings that are attached to respective ends of the plurality of electrical wires; and the terminal holder according to claim 1 for accommodating the plurality of terminal fittings.

6. A fixing structure for fixing the plurality of terminal fittings that are attached to respective ends of the plurality electrical wires to a terminal block, the fixing structure comprising the terminal holder according to claim 1 to be fixed to the terminal block and for accommodating the plurality of terminal fittings.

7. The terminal holder according to claim 1, wherein the partition wall includes first partition walls forming a respective one of the plurality of through holes and second partition walls forming a respective one of the plurality of accommodations, the respective through hole communicating with the respective accommodation, and a distance between the first partition walls across the respective through hole is greater than a distance between the second partition walls across the respective accommodation.

8. A terminal holder for accommodating a plurality of terminal fittings that are attached to respective ends of a plurality of electrical wires, each of the plurality of terminal fittings including a connection that is connected and fixed to an attachment object, and a fixing portion that is fixed to the electrical wire, wherein in a state of being accommodated in the terminal holder, the connections of the plurality of terminal fittings are arranged in a line, and the plurality of electrical wires are drawn out in a direction orthogonal to an arrangement direction of the connections, the terminal holder comprising:

a partition wall continuously extending between the fixing portions and between the connections of adjacent terminal fittings, wherein the partition wall between the fixing portions of the adjacent terminal fittings is composed of two walls that are separated by a predetermined distance, such that a protruding portion of the terminal holder fits between the two walls.

* * * * *